US006905274B2

(12) United States Patent
Zwaert et al.

(10) Patent No.: US 6,905,274 B2
(45) Date of Patent: Jun. 14, 2005

(54) LIQUID APPLICATOR

(75) Inventors: Kevin J. Zwaert, Chicago, IL (US); Todd A. Zeilinger, Chicago, IL (US); Juli A. Bohm, Wheeling, IL (US); Jordan I. Rotheiser, Highland Park, IL (US); David Hidding, Barrington, IL (US)

(73) Assignee: Rust-Oleum Corporation, Vernon Hills, IL (US)

( * ) Notice: Subject to any disclaimer, the term of this patent is extended or adjusted under 35 U.S.C. 154(b) by 0 days.

(21) Appl. No.: 09/928,251

(22) Filed: Aug. 10, 2001

(65) Prior Publication Data

US 2002/0070232 A1 Jun. 13, 2002

Related U.S. Application Data

(60) Provisional application No. 60/224,947, filed on Aug. 11, 2000.

(51) Int. Cl.[7] ..... B43M 11/06; B43M 11/02

(52) U.S. Cl. ..... 401/186; 401/185; 401/219

(58) Field of Search ..... 401/183–186, 401/270, 278, 219, 220, 203, 204, 205, 208

(56) References Cited

U.S. PATENT DOCUMENTS

| | | | | | |
|---|---|---|---|---|---|
| 1,425,242 | A | * | 8/1922 | Dinardo | 401/187 |
| 2,582,861 | A | * | 1/1952 | Coombs | 401/208 |
| 2,721,347 | A | * | 10/1955 | Benkowski | 401/208 |
| 4,909,265 | A | * | 3/1990 | Goncalves | 132/317 |
| 5,213,431 | A | * | 5/1993 | Gentile et al. | 401/219 |
| 5,308,182 | A | * | 5/1994 | Lampert | 401/219 |
| 6,053,650 | A | | 4/2000 | Bennett et al. | |
| 6,386,782 | B1 | * | 5/2002 | White, Sr. | 401/220 |
| 6,439,381 | B1 | | 8/2002 | Alvarez | |

* cited by examiner

*Primary Examiner*—David J. Walczak
(74) *Attorney, Agent, or Firm*—McDonnell Boehnen Hulbert & Berghoff LLP

(57) ABSTRACT

A fillable container and applicator for storing and then later applying liquids such as paints, dyes, and varnishes to a surface, the container including a resilient bottle adapted to hold a liquid including a open end, a pin that fits over the bottle open end that includes a opening complementary to the bottle open end, a cap that fits over the pin that includes an opening complementary to the bottle open end, an applicator holder and a liquid applicator.

14 Claims, 11 Drawing Sheets

LIQUID APPLICATOR

This application claims benefit of U.S. Provisional Application 60/224,947 filed Aug. 11, 2000.

BACKGROUND OF THE INVENTION (1) Field of the Invention

This invention concerns a fillable liquid applicator that is useful for storing liquids such as paints, dyes, varnishes and so forth and then later using the applicator to apply the liquid to a surface.

(2) Description of the Art

Liquids such as paint, dyes, sealers, and so forth are typically sold in cans and bottles and applied to walls, cloth, floors and so forth. Typically, the unused portion of the liquid is kept in the originally purchased container which is re-sealed after use and stored. The original liquid containers are quite large and require a large amount of storage space even though the amount of liquid left in the container is quite small. Often the unused liquids in the re-sealed containers evaporate because of an inadequate seal or become contaminated so that when the originally applied paint, dye or other liquid requires refreshing or retouching, the unused re-sealed liquid material is unusable.

While there are many applicators available in the prior art for applying newly purchased paints, dyes and other liquids to surfaces, they do not provide the user with a storage container for left over liquids that can also be used to apply the liquid to a surface. Thus, there is a need for a container that is capable of storing residual paints, dyes and other liquid materials and that is also capable of being used to apply the liquid to a surface.

SUMMARY OF THE INVENTION

It is an object of this invention to provide a liquid applicator that is capable of being filled with a liquid such as paint, storing the liquid for an extended period of time, and then using it to apply the liquid to a surface.

It is another objection of this invention to provide a liquid applicator that is refillable, that is reusable, and that may be associated with various types of applicators.

It is yet another object of this invention to provide a liquid applicator that is small in size, that is ergonomic, and that is useful for touchup projects and for applying a liquid to hard to reach areas.

It is still another object of this invention to provide a liquid applicator that may be associated with a roller for applying a liquid where the roller is easily removed from the applicator.

In one embodiment, this invention is a liquid applicator including a resilient bottle, a pin, a cap and an applicator holder. The liquid applicator resilient bottle is adapted to hold a liquid and includes an opening. The pin includes a body having a first opening and a second opening wherein the pin body at least partially surrounds the resilient bottle and wherein the resilient bottle opening is concentric to the pin second opening. The liquid applicator cap includes a first open end, and a second open end wherein the pin first aperture fits into the cap first open end and wherein the pin second opening is concentric to the cap second open end. The resilient bottle further includes an applicator holder wherein the applicator holder is typically united with the cap outer surface.

In another embodiment, this invention is a liquid applicator comprising a resilient bottle, a pin, a cap, and an applicator. The liquid applicator resilient bottle is adapted to hold a liquid and includes a hollow body, an opening and a neck located between the hollow body and the opening wherein the neck has a threaded outer surface. The liquid applicator pin includes a body forming a first opening and a second opening forming a nozzle wherein the pin body at least partially surrounds the resilient bottle and wherein the resilient bottle opening is concentric to the pin second opening, the pin further including an annular wall having a first end associated with a shoulder dividing pin first opening from pin second opening and a threaded inner surface wherein the threaded inner surface is complementary to the threads on bottle neck outer surface, and a neck located between the shoulder and the nozzle wherein the neck includes a threaded outer surface. The liquid applicator cap includes a first open end, a second open end, wherein the pin first opening is united with cap first open end and wherein the pin second opening is concentric to the cap second open end. Cap first open end is an annular wall having an inner surface and an outer surface wherein the annular wall inner surface includes threads that are complementary to threads on the pin neck outer surface. The liquid applicator further includes an applicator holder attached to the cap and an applicator associated with the applicator holder such that the applicator is positioned adjacent to the cap first open end.

In yet another embodiment, this invention is a liquid applicator comprising a resilient bottle, a pin, a cap and an applicator holder. The resilient bottle is adapted to hold a liquid and includes an opening and a locator bump. The pin includes a body that forms a first opening and a second opening wherein the pin body at least partially surrounds the resilient bottle and wherein the resilient bottle opening is concentric to the pin second opening. The pin further includes a recess complementary to the resilient bottle locator bump. The cap includes a first open end and second open end wherein the pin first open end is united with cap first opening and wherein the pin second open end is concentric to the cap second opening. The applicator also includes an applicator holder that is adapted to accept an applicator.

In still another embodiment, this invention is a liquid applicator including a resilient bottle, a pin, a cap, and an applicator holder. The resilient bottle is adapted to hold a liquid and has an opening. The pin includes a body forming a first opening and a second opening wherein the pin body at least partially surrounds the resilient bottle and wherein the resilient bottle opening is concentric to the pin second opening. The pin further includes a detent. The cap includes a first open end and second open end wherein the pin first open end is united with cap first opening and wherein the pin second open end is concentric to the cap second opening and wherein the cap includes at least one rib that engages the pin detent. The liquid applicator also includes an applicator holder that is adapted to accept an applicator.

A further embodiment of this invention is a liquid applicator including a resilient bottle, a pin, a cap, and an applicator holder. The resilient bottle is adapted to hold a liquid and includes an opening. The pin includes a body forming a first opening and a second opening wherein the pin body at least partially surrounds the resilient bottle and wherein the resilient bottle opening is concentric to the pin second opening. The cap includes a first open end and second open end wherein the pin first open end is united with cap first opening and wherein the pin second open end is concentric to the cap second opening. The cap further includes a seal hood. The liquid applicator also includes an applicator holder adapted to accept an applicator.

In still another embodiment, this invention includes methods to fill the liquid applicator with a liquid and for using the liquid applicator to apply a liquid to a surface.

DESCRIPTION OF THE CURRENT EMBODIMENT

The present invention relates to a liquid applicator that can be filled with a liquid, that can be used to store the same liquid, and that can be used at a later time to apply the stored liquid such as paint, dye, varnishes and so forth to a surface. The liquid applicator of this invention is especially useful for being filled with, storing and applying paints and other liquids for home improvement projects. The liquid applicator of this invention is capable of holding liquids for an extended period of time. When needed, the applicator can be used, for example, to touch up surfaces which were painted with the same paint stored in the liquid applicator without any preparation. The liquid applicator of this invention is also useful for applying a liquid to small or confined areas that are difficult to reach with conventional brushes or rollers.

Figure 1A:
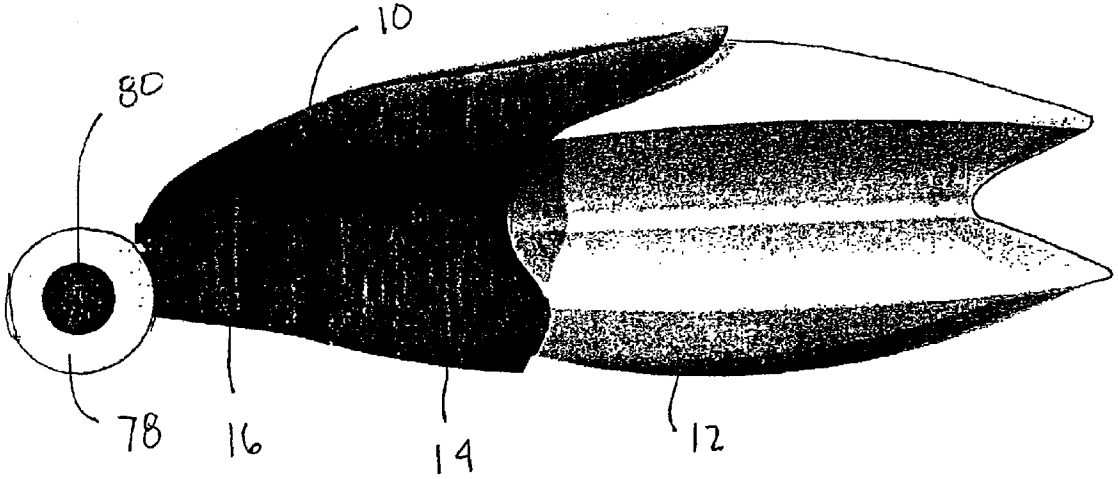
FIG. 1A is a side view of a liquid applicator of this invention.
Figure 1B:
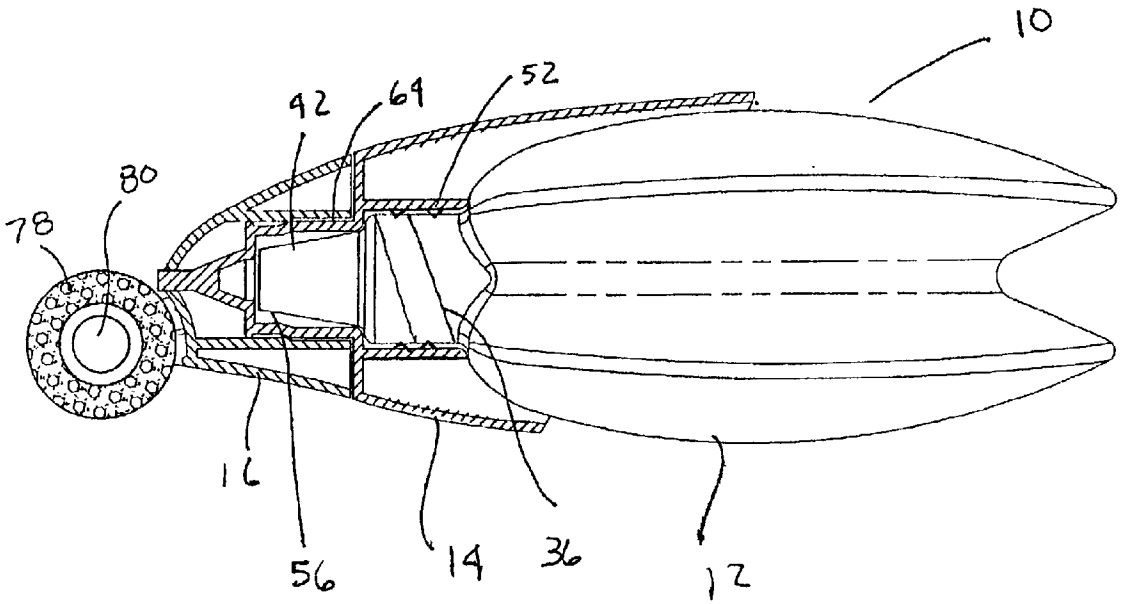
FIG. 1B is a side cutaway view of a liquid applicator of this invention.

Referring now to the Figures, FIGS. 1A and 1B are a side view and a side cutaway view respectively of a liquid applicator of this invention. The liquid applicator includes three primary elements and several optional elements. The primary elements are a resilient bottle 12, a pin 14 and a cap 16. Resilient bottle 12 nests inside pin 14 which in turn nests inside cap 16 to form liquid applicator 10. An applicator 78 is used to apply the liquid held in resilient bottle 12 to a surface. In FIG. 1B, the pin 14 and cap 16 are shown as separate elements. However, it is within the scope of this invention that pin 14 and cap 16 form a single structure. When pin 14 and cap 16 form a single structure, then liquid applicator 10 may include a cap or other means for sealing liquid applicator 10 when it is not in use. It is preferred that pin 14 and cap 16 are separate structures and that cap 16 is capable of moving axially with respect to pin 14 to allow for liquid flow during the applicator use and to prevent liquid flow when the applicator is not being used.

Figure 2B:
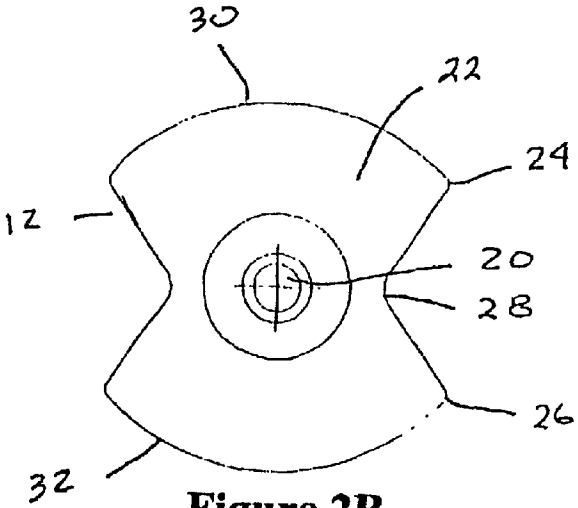
FIGS. 2A, 2B and 2C are side, end and end cutaway views respectively of a resilient bottle of a liquid applicator of this invention.
Figure 2C:
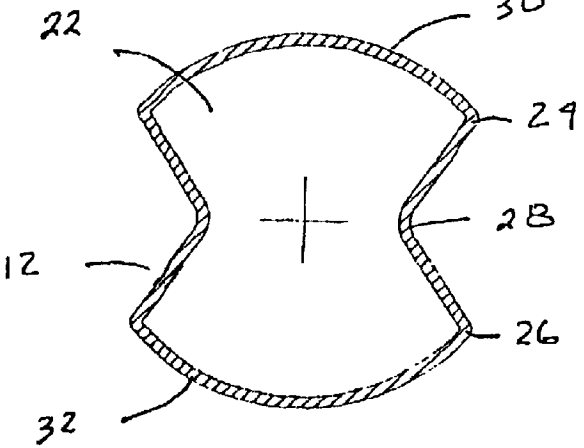
Figure 2A:
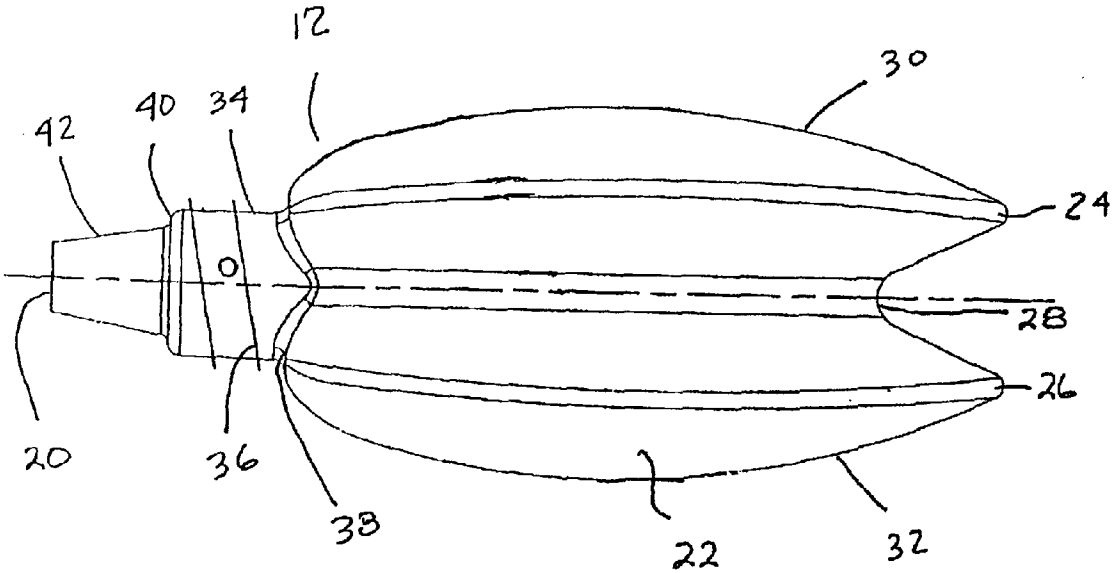
Figure 3B:
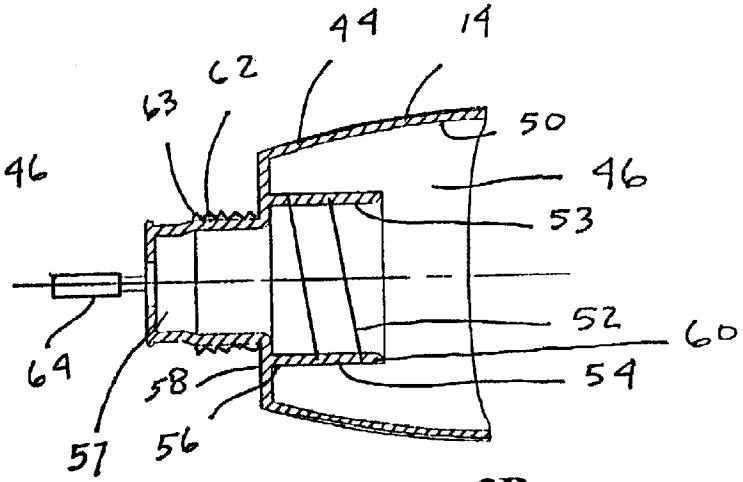
FIGS. 3A and 3B are top and top cutaway views of a pin portion of a liquid applicator of this invention.
Figure 3A:
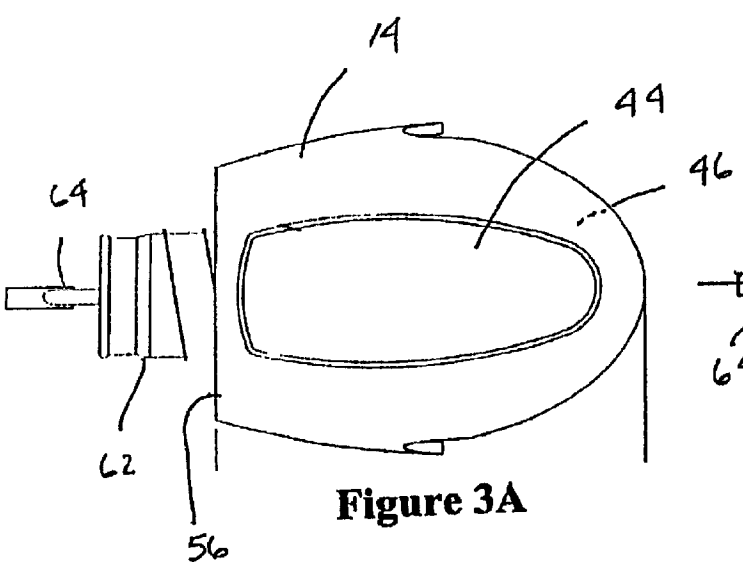
Figure 4B:
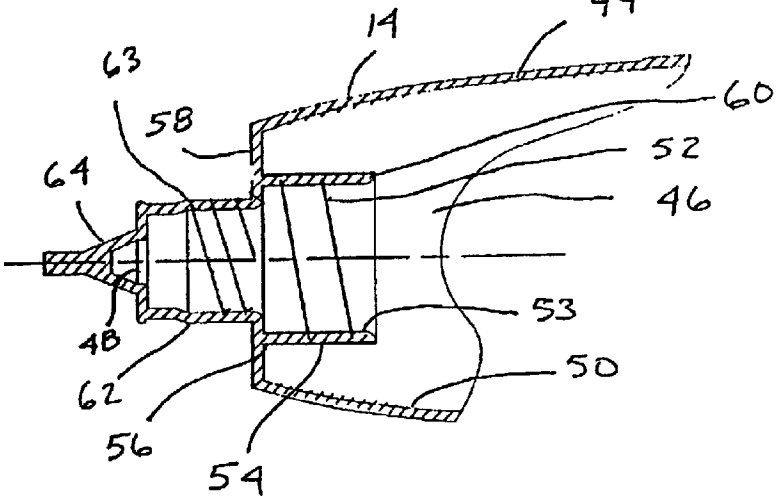
FIGS. 4A and 4B are side and side cutaway views of a pin of a liquid applicator of this invention.
Figure 4A:
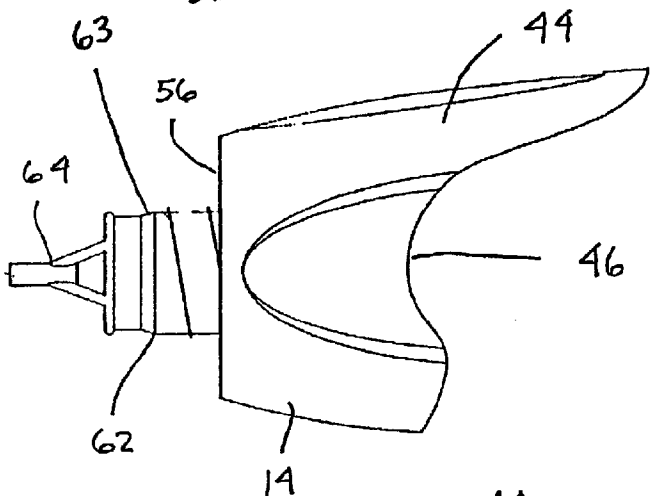

An embodiment of a liquid applicator resilient bottle 12 is shown in more detail in FIGS. 2A–2C. Resilient bottle 12 is adapted to hold a liquid and includes an opening 20 associated with one end of the bottle. The remainder of resilient bottle 12 is a hollow body 22 which is capable of retaining a liquid. Resilient bottle 12 may be manufactured from any material that can be manually squeezed to both remove air from the bottle so that it may be filled with a liquid and to force liquid located inside hollow bottle 22 out of opening 20. Resilient bottle 12 is preferably made of material such as soft plastic that is resilient enough to return to its original form after being squeezed. It is preferred that resilient bottle is manufactured from low density polyethylene.

A preferred resilient bottle 12 will include a first crease 24, a second crease 26, an indentation 28 located between first crease 24 and second crease 26, a first rounded surface portion 30 and a second rounded surface portion 32. The combination forms a bellows-like structure that can be easily squeezed by hand. Resilient bottle 12 shown in FIGS. 2A–2B is squeezed by placing ones fingers on first rounded surface portion 30 and second rounded surface portion 32 and squeezing. Squeezing resilient bottle 12 is necessary during manual filling to remove air from resilient bottle 12 so that it may be filled with a liquid. Squeezing resilient bottle 12 when full with liquid forces the liquid inside resilient bottle 12 out of opening 20.

Resilient bottle 12 may include a neck 34 having an threaded outer surface 36. Resilient bottle 12 may also include a first shoulder 38 located between hollow body 22 and neck 34 and a second shoulder 40 located between neck 34 and opening 20 wherein first shoulder 38 is larger than second shoulder 40. Furthermore, as shown in FIG. 2A, opening 20 is preferably nozzle shaped and more preferably opening 20 is a tapered nozzle 42.

It is preferred that opening 20 is of a diameter that is sufficient to quickly fill resilient bottle 12 but that is not so large that the liquid that enters resilient bottle 12 during the vacuum filling procedure leaks from resilient bottle 12 in a significant amount as the bottle is being removed from the filling liquid. It is preferred that opening 20 has a diameter ranging from about 0.10 inches to about 0.8 inches. The diameter can be larger or smaller depending upon factors such as fluid viscosity, the resiliency of the bottle and so forth. More preferably, opening 20 will have a diameter of from about 0.25 to about 0.4 inches. An opening 20 with a diameter below about 0.25 inches, while useful, generally fills at a rate that some users might find to be too slow while an opening greater than about 0.4 inches can, depending upon the fluid viscosity, allow a significant amount of liquid to leak from resilient bottle 12 at the end of the vacuum filling procedure. Most preferably, opening 20 has a diameter of from 0.35 inches to about 0.375 inches with a diameter of about 0.375 inches being most suitable.

Resilient bottle 12 can be filled with a liquid by several methods. In one method, the vacuum filling method, hollow body 22 of resilient bottle 12 is squeezed to force air out of resilient bottle 12. While still squeezing resilient bottle 12, opening 20 is placed in a liquid being transferred to resilient bottle 12 and squeezing is stopped. Once squeezing is stopped, the walls of hollow body 22 return to their original shape thereby creating a vacuum that draws liquid into resilient bottle 12. Opening 20 of resilient bottle 12 is removed from the liquid when filling is complete. Resilient bottle 12 can be disengaged from pin 14 and cap 16 before filling or it may remain associated with pin 14 and cap 16 during filling.

In an alternative method, liquid applicator 10 of this invention can be filled pouring a liquid through opening 20 of resilient bottle 12 with or without the aid of a funnel. Alternatively, liquid can be injected into resilient bottle 12 through opening 20 or through a resealable portion of the bottle wall. If resilient bottle 12 is filled by pouring or injecting a liquid into resilient bottle 12, then opening 20 should be of a size sufficient to accept the liquid.

An embodiment of pin 14 of a liquid applicator 10 of this invention is shown in FIGS. 3A–3B and 4A–4B. Pin 14 includes body 44 that is manufactured from a rigid material such as rigid plastic, metal or any other material that is not resilient. A preferred plastic is high density polyethylene. One function of body 44 is to allow liquid applicator 10 to be held while squeezing resilient bottle 12 and to be held without squeezing resilient bottle 12. This allows the user of liquid applicator 10 to squeeze liquid onto an applicator and then hold the liquid applicator while applying the liquid to a surface without forcing any additional liquid from resilient bottle 12. Pin 14 further includes a first opening 46 and a second opening 48. First opening 46 is of sufficient size to surround a portion of resilient bottle 12 and preferably at least opening 20 and optional neck 34 of resilient bottle 12. Second opening 48 of pin 14 is complementary to opening 20 of resilient bottle 12 and is used to direct liquid from resilient bottle 12 through opening 20, through second opening 48 and onto or into a liquid applicator. Pin 14 includes plug 64 associated with second opening 48. In a preferred embodiment shown in FIGS. 3A–3B and 4A–4B, pinplug. 64 is associated with second opening 48 of pin 14 in a manner that does not prevent liquid from flowing from opening 20 of resilient bottle 12 through second opening 48.

Resilient bottle 12 may be united with pin 14 by any means known in the art. Pin 14 further includes an inner surface 50. Resilient bottle 12 may be irreversibly united with pin 14 using an adhesive for example. Alternatively resilient bottle 12 may be reversibly united with pin 14 using any known reversible attaching methods such as threads, locking tabs and so forth. In a preferred embodiment shown in FIGS. 3B and 4B, pin 14 includes threads 52 that are complementary to threads 36 of resilient bottle 12. Threads 52 are associated with the inner surface 53 of pin annular wall 54 wherein annular wall 54 has a first end 56 associated with a shoulder 58 and an open second end 60. Pin neck 62 extends beyond shoulder 58 opposite annular wall 54 and includes second opening 48.

When pin 14 and cap 16 are separate elements, pin 14 includes a device for uniting pin 14 with cap 16. Pin 14 may be reversibly or irreversibly united with cap 16. In a preferred embodiment shown in the Figures, pin 14 includes a neck 62 with a threaded outer surface 63. Threaded outer surface 63 is complementary to threads of cap 16. As shown in FIG. 1B, threaded outer surface 36 of resilient bottle 12 is preferably associated with threads 52 of pin 14 and resilient bottle is indexed towards neck 62 of pin 14 until nozzle 42 of resilient bottle 12 is secured in complimentary recess 57 of pin 14.

Figure 5A:
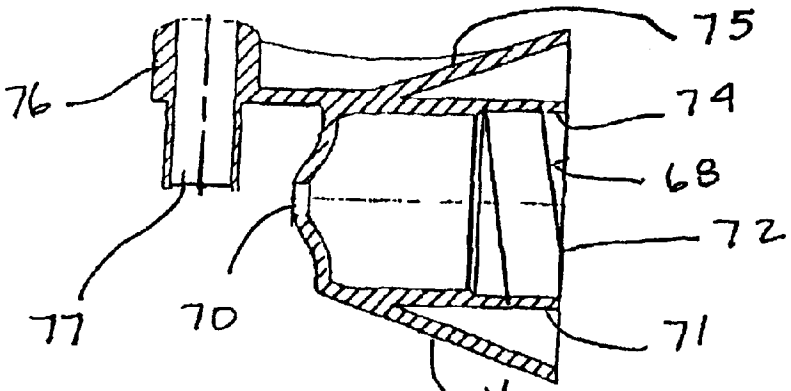
FIGS. 5A, 5B and 5C are top cutaway, side cutaway and end views respectively of a cap of a liquid applicator of this invention.
Figure 5B:
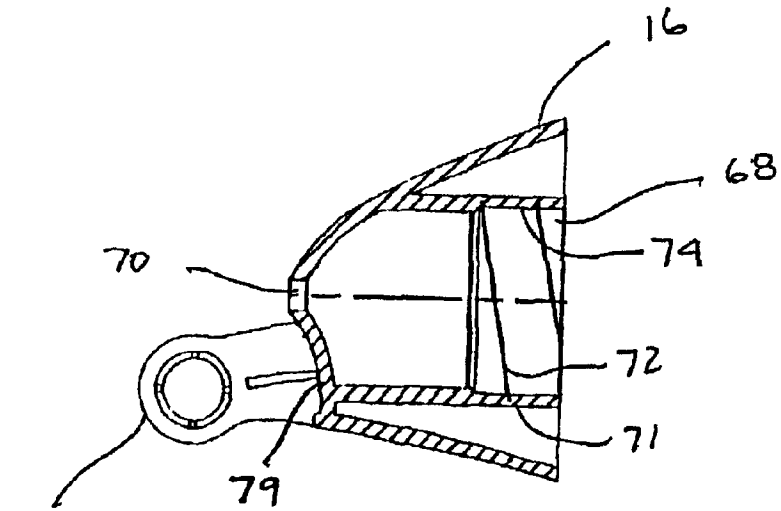
Figure 5C:
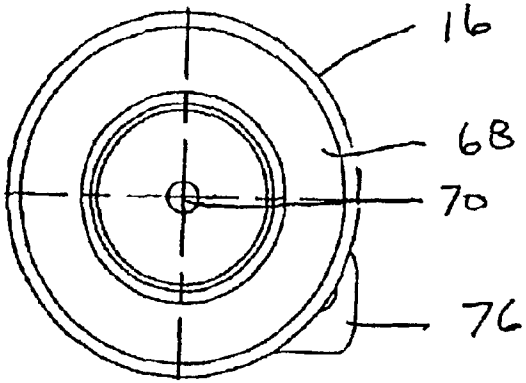

Liquid applicator 10 further includes a cap 16. Cap 16 allows liquid applicator 10 to be sealed during storage and unsealed for use. Furthermore, cap 16 optionally provides a site to which an applicator holder is associated with liquid applicator 10. As with pin 14, cap 16 is preferably manufactured of a rigid material such as a rigid plastic material. Preferably, cap 16 is made of the same material as pin 14. Details of a preferred cap embodiment are found in FIGS. 5A–5C. Cap 16 includes a first open end 70 and a second open end 68 opposite first open end 70. Second open end 68 is large enough to encompass the front portion of pin 14 that includes pin second opening 48. In a preferred embodiment, cap 16 second open end 68 is an annular wall 71 including threads 72 associated with inner surface 74 of annular wall 71. Threads 72 are complementary to threads 63 on the outer surface of pin neck 62. While cap 16 shown in FIGS. 5A–5C is threaded onto pin 14, cap 16 and pin 14 may be united by any other means known in the art such as by using adhesives, by using tabs, pins and keyways, or by any other reversible or permanent uniting means known in the art. It is preferred that pin 14 is reversibly threaded into cap 16.

Cap 16 and pin 14 are preferably axially movable with respect to one another. Moving cap 16 axially with respect to pin 14 causes plug 64 to block first open end 70 when cap 16 is moved axially towards pin 14. When plug 64 blocks first open end 70, the liquid in resilient bottle 12 is prevented from exiting liquid applicator 10. When cap 16 is moved axially away from pin 14, first open end 70 becomes unobstructed by plug 64 and liquid is able to flow from resilient bottle 12 out of first open end 70 of liquid applicator 10. In a preferred embodiment, cap 16 is axially moved with respect to pin 14 using threads 63 associated with pin 14 and threads 72 associated with cap 16 wherein the turning of cap 16 with respect to pin 14 causes cap 16 to move axially towards or away from cap 14.

Cap 16 further includes an applicator holder 76. Applicator holder 76 is attached to outer surface 75 of cap 16 and provides a site to attach an applicator 78 to liquid applicator 10. Applicator 78 may be any type of applicator known in the art for applying a liquid to a surface. Examples of applicators include brushes, rollers, pads and so forth. The size of the applicator as well as the material used to manufacture the applicator may vary depending upon the liquid that will be applied from liquid applicator 10. In addition, when applicator 78 is a pad or roller, the pad or roller may include variations in surface texture and nap.

It is preferred that applicator 78 is a roller that is associated with applicator holder 76. The roller may be made of any material useful for applying the liquid held in the liquid applicator 10 to a surface. For example, the roller may be a solid rubber roller when it is used for applying ink to a stencil or other surface. Alternatively, the roller can be made of felt or foam when the liquid is a paint or varnish that is being applied to a surface. When the liquid applied by a liquid applicator 10 is paint, then it is preferred that the roller is a foam material that has a density of from 1 to 8 pounds per square foot and preferably a density from 4 to 7 pounds per square foot. A preferred foam is polyester foam having a density of about 6 pound per square foot. The roller will generally be from about ½ to 2 inches in width.

In order to facilitate positioning of a preferred roller with respect to first open end 70, cap 16 preferably includes a concave front surface portion 79 that is complementary to a roller. Concave surface portion 79 allows the roller (shown in FIG. 1B) to be positioned relative to first open end 70 of pin 16 such that paint or other liquid exiting first open end 70 can not easily bypass roller 78. This prevents liquid exiting liquid applicator 10 from bypassing the applicator.

Regardless of the type of applicator 78 chosen, it is important that applicator holder 76 positions applicator 78, in front of cap first open end 70. While is it preferred that pin 14 includes a plug that is used to seal liquid applicator 10 while not in use, second opening 70 may be sealed using a non-integral element such as a plug or a piece of tape.

Liquid applicator 10 is used by removing the device sealing first open end 70 of cap 16 or by indexing cap 16 away from pin 14 such that plug 64 no longer impedes flow of liquid through first open end 70. If not already in place, an applicator 78 is associated with applicator holder 76 and the user squeezes hollow body 22 of resilient bottle 12 in order to force liquid from hollow body 22, through opening 20, through first open end 70 and onto a surface or onto applicator 78. Once a sufficient amount of fluid has been squeezed from resilient bottle 12, the user can shift their finger position and hold the pin and/or cap portion of liquid applicator 10 in order to apply the liquid to a surface.

Figure 6A:
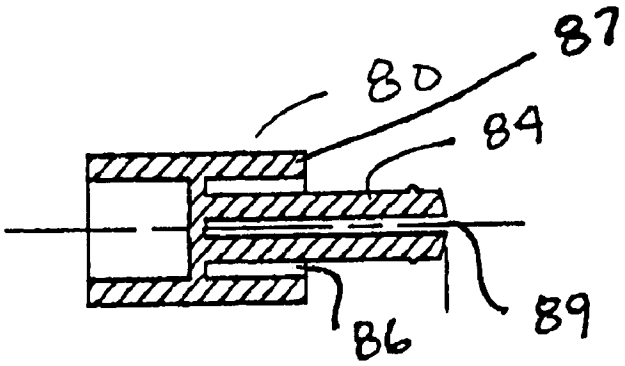
FIGS. 6A and 6B are a side view and a side cutaway view of a roller core of a liquid applicator of this invention.
Figure 6B:
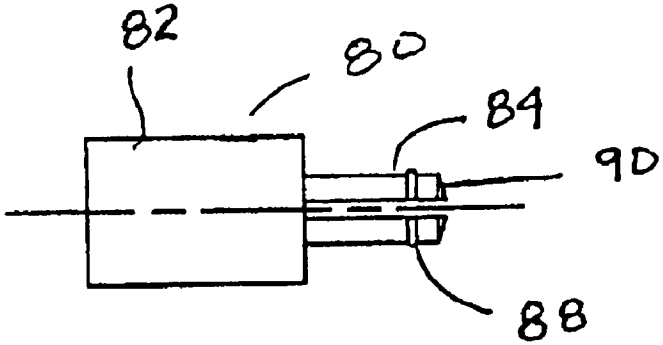

FIGS. 6A and 6B show an optional roller core 80 that is associated with an applicator 78 and preferably associated with a roller. The purpose of roller core 80 is to allow a user of the liquid applicator to easily attach and separate the combined roller core 80 and applicator 78 from liquid applicator 10 using a single hand. Roller core 80 includes a first annular surface 82 and a two-piece pin 84. Two-piece pin 84 includes an annular recess 86. First annular surface 82 is designed to be associated with the inside surface of a roller. Typically the roller inside surface will be glued to first annular surface 82. Two-piece pin 84 includes a ridge 88. Two-piece pin 84 fits into aperture 77 of applicator holder 76. Two-piece pin 84 is indexed into roller aperture 76 until ridge 88 extend beyond the opposite end of aperture 77 of applicator holder 76. Gap 89 in pin 84 allows two-piece portions of pin 84 to be squeezed together as roller core 80 is being indexed into applicator holder 76. Once pin 84 exits aperture 77 two-piece pin 84 moves apart and roller core 80 is locked into position by ridge 88. Annular recess 86 is complementary to walls 87 of applicator holder 76. Because roller core 80 is annular in shape, roller core can rotate simultaneously with applicator 78 while applicator holder 76 remains stationary. To remove roller core 80 from applicator holder 76, two-piece pin 84 is squeezed together or tip 90 of roller core 80 is pressed both of which release ridges 88 and allows roller core 80 to disengage from applicator holder 76.

Figure 8:
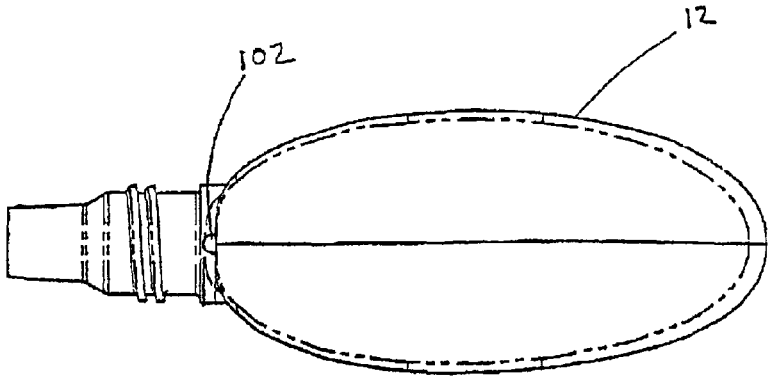
FIG. 8 is a side cutaway view of an alternative embodiment of a bottle useful in liquid applicators of this invention.
Figure 9A:
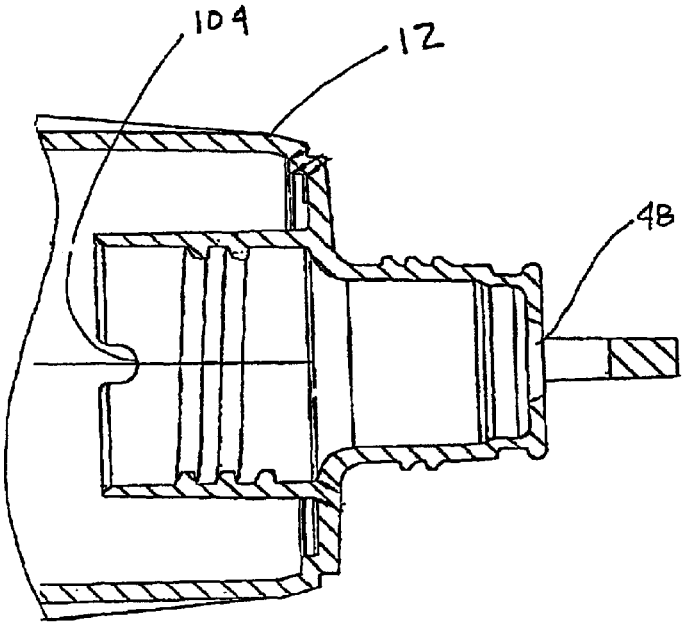
FIGS. 9A and 9B are end views of an alternative grip embodiment useful in liquid applicators of this invention.
Figure 9B:
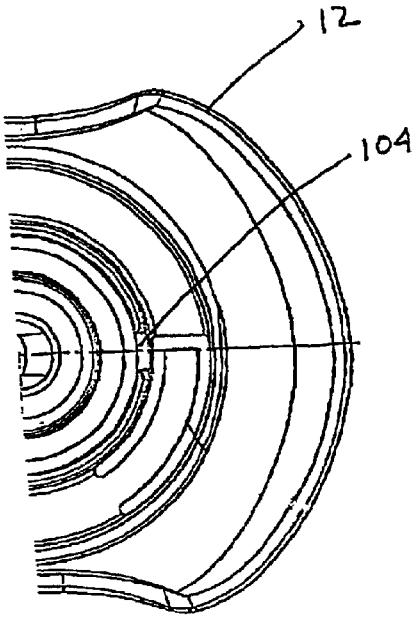

FIGS. 8–14 show alternative and sometimes preferred aspects of liquid applicators of this invention. FIG. 8 is a side view of resilient bottle 12 including a locator bump 102. FIGS. 9A and 9B show a pin 14 including a recess 104 that is complementary to locator bump 102. When pin 14 is associated with resilient bottle 12, preferably by threading pin 14 onto resilient bottle 12, locator bump 102 engages and become located in recess 104 thereby preventing further rotation or manipulation of pin 14 with respect to resilient bottle 12 and ensuring that resilient bottle 12 and pin 14 always have the same orientation when coupled.

Figure 10:
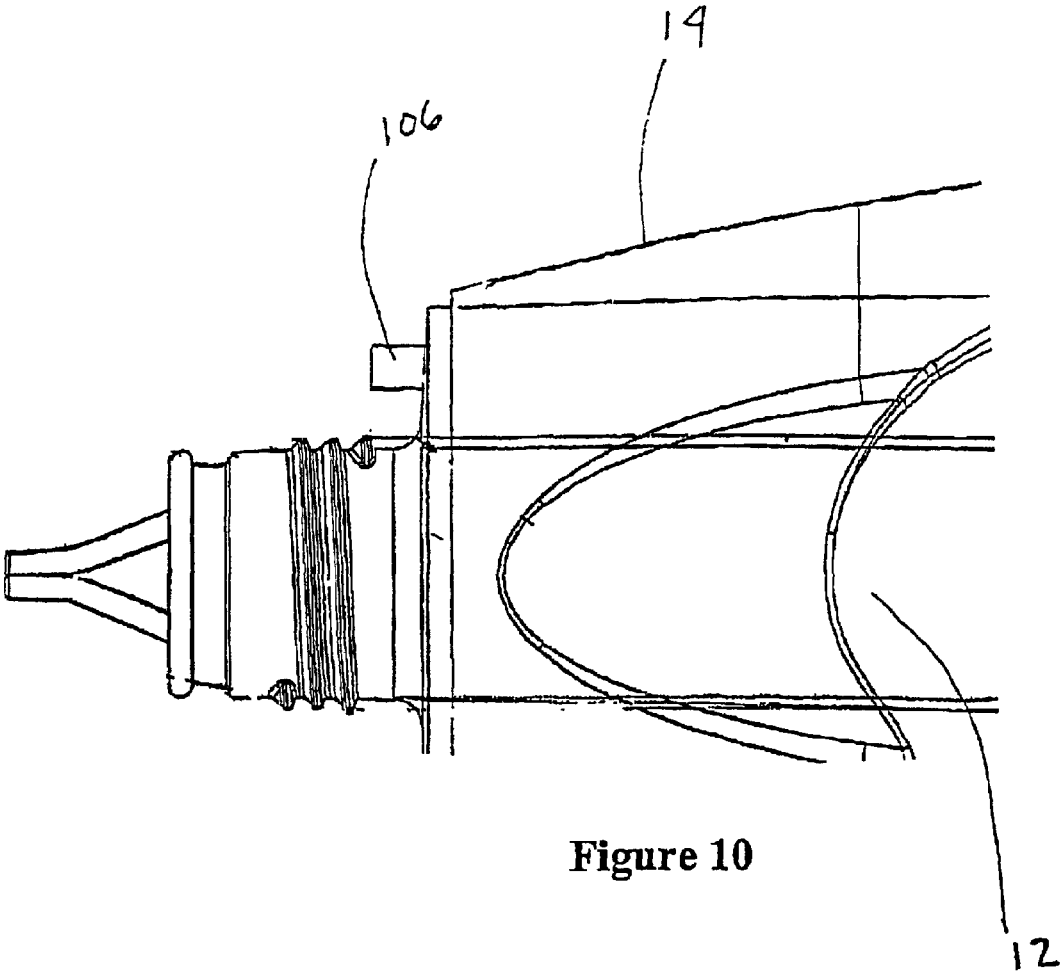
FIG. 10 is a side view of an alternative grip embodiment including snap detent __.
Figure 11:
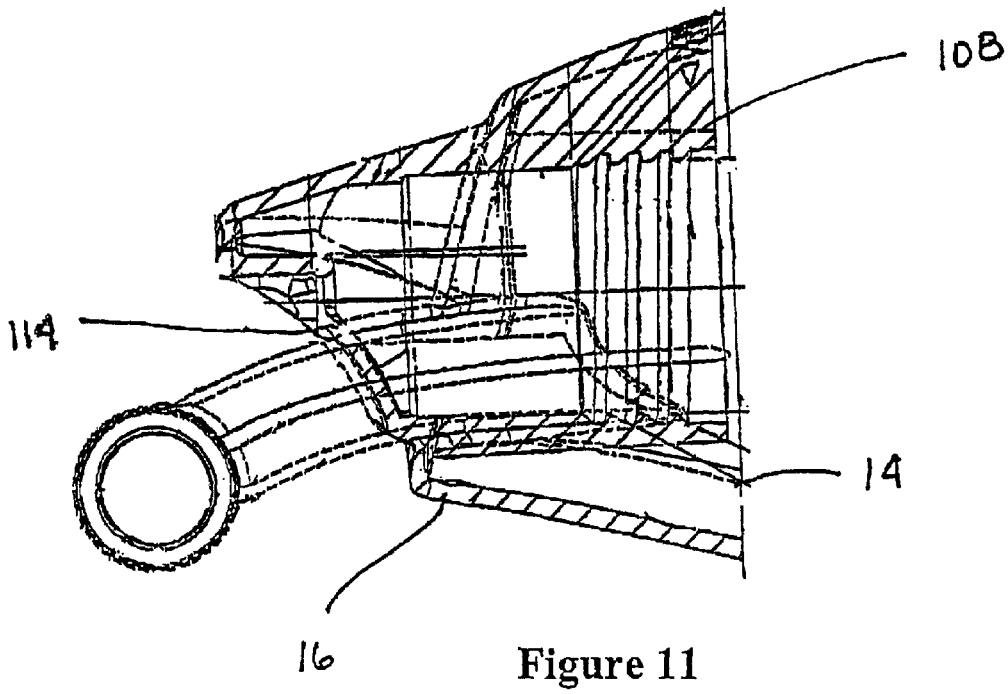
FIG. 11 is a side assembly view of the front portion of a liquid applicator embodiment of this invention.

FIG. 10 is a partial side view of an alternative embodiment of pin 14 including a detent 106. Detent 106 in conjunction with rib 108 to ensure that pin 14 and cap 16 are always oriented in the same relative position (preferably the position shown in FIG. 1A) whenever pin 14 and cap 16 are united. Detent 106 and rib 108 are preferably engaged when cap 16 is threaded onto cap 14. When cap 16 is threaded almost completely onto pin 14, rib 108 will encounter detent 106 and will inhibit the further threading of cap 16 onto pin 14 and orienting cap 16 with respect to pin 14 and resilient bottle 12.

Figure 12A:
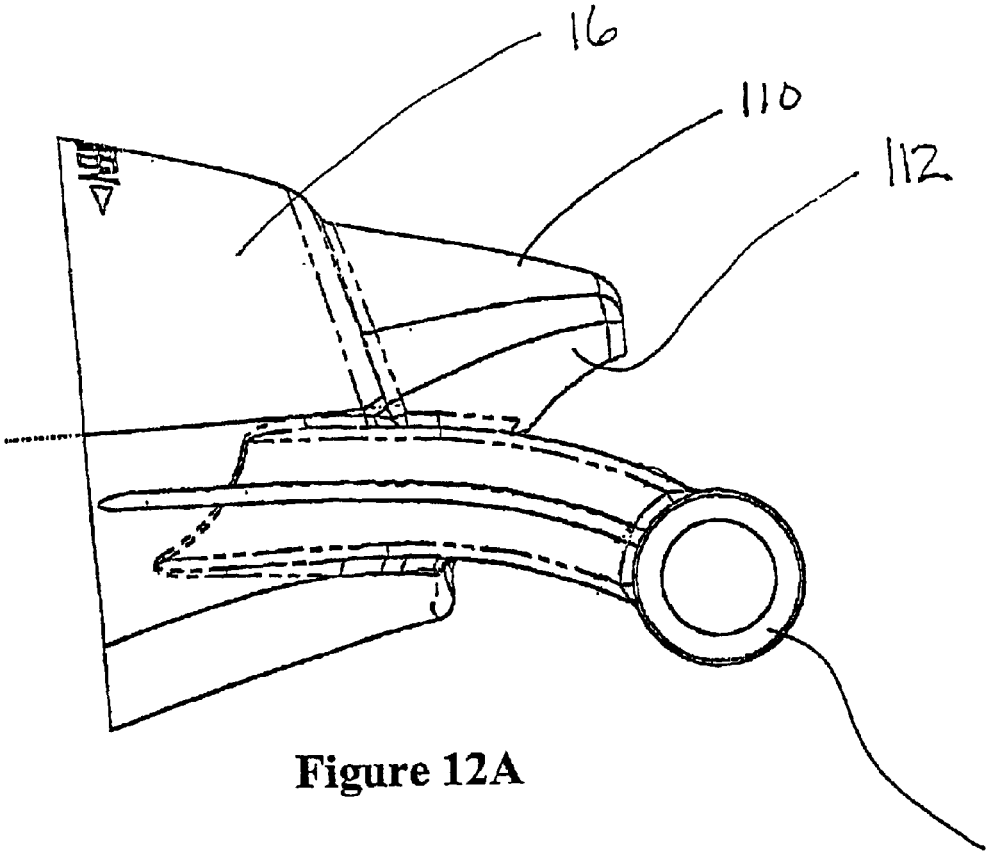
FIGS. 12A and 12B are side and side assembly views of the applicator portion of a liquid applicator embodiment of this invention.
Figure 12B:
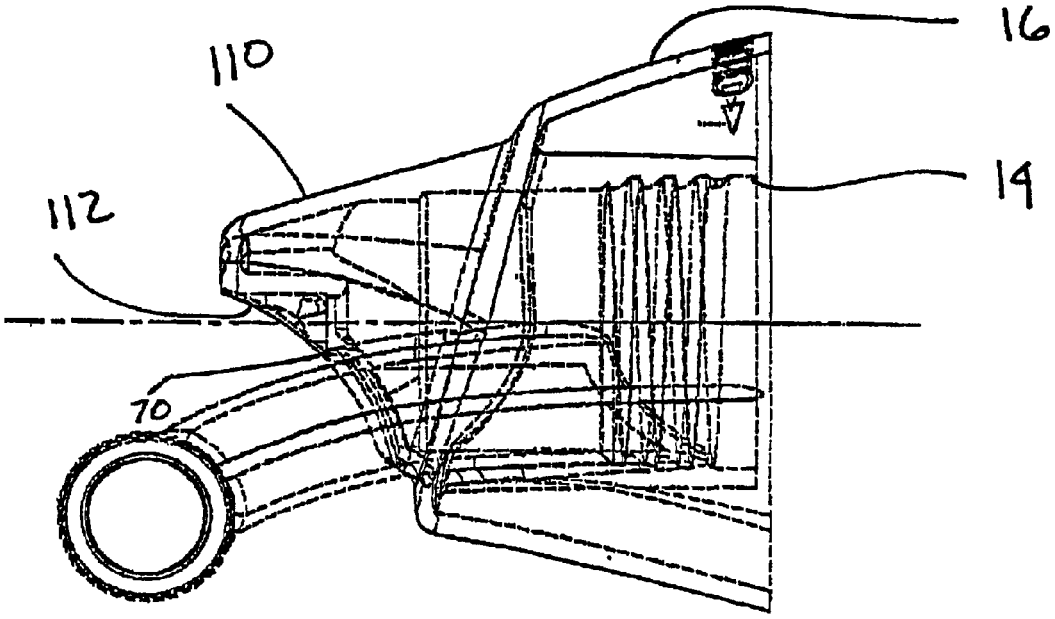

FIGS. 12A and 12B show a preferred seal hood 110 associated with cap 16. Seal hood 110 has a curved inner face 112 that is complementary to the curve of applicator 78. Seal hood 110 prevents the spattering of liquid as it is applied to applicator 78 from resilient bottle 12. In a preferred embodiment, first open end 70 of pin 14 is oriented such that liquid passes through first open end 70 into an enclosed space defined by seal hood 110 and applicator 78 thereby inhibiting liquid splatter and drips.

In another embodiment of this embodiment shown in FIGS. 12A and 12B, first open end 70 is oriented with respect of applicator 78 at an angle greater or less than 90 degrees. Orienting first open end 70 and applicator 78 in such a manner makes it easier to direct liquid from resilient bottle 12 through first open end 70 and onto applicator 78.

Figure 13:
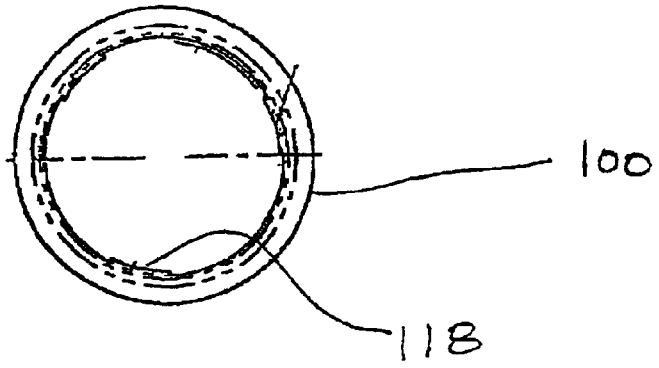
FIG. 13 is an end view of a roller sleeve 100 that is useful in liquid applicator embodiments of this invention.
Figure 14:
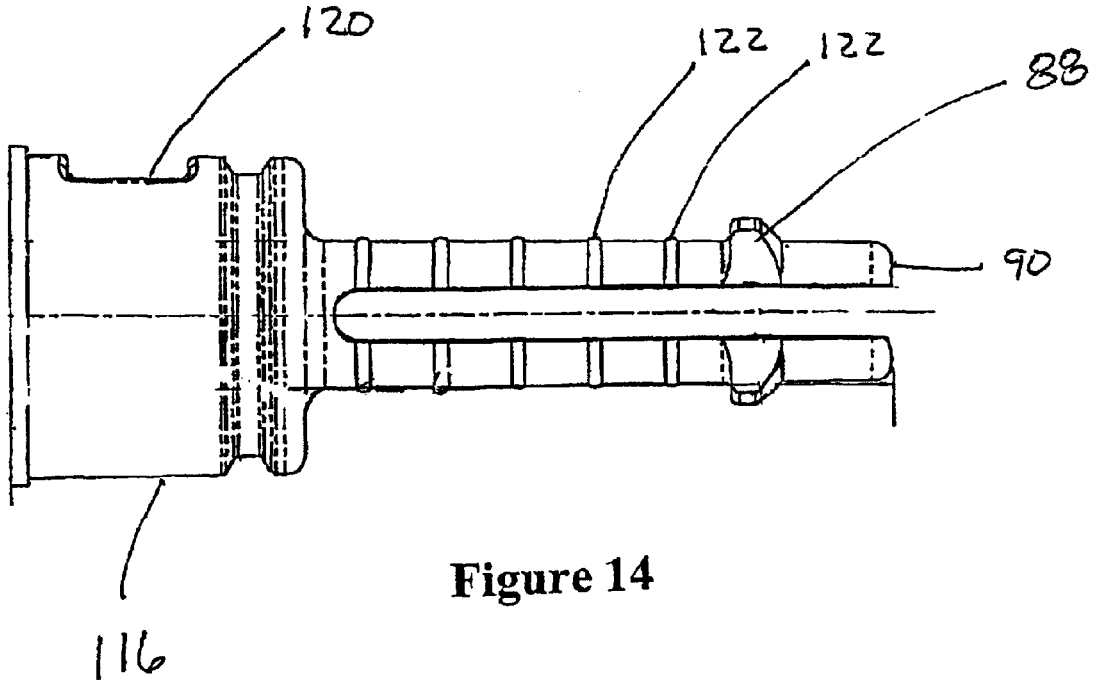
FIG. 14 is a side view of an applicator holder embodiment useful in conjunction with liquid applicators of this invention.
Figure 15B:
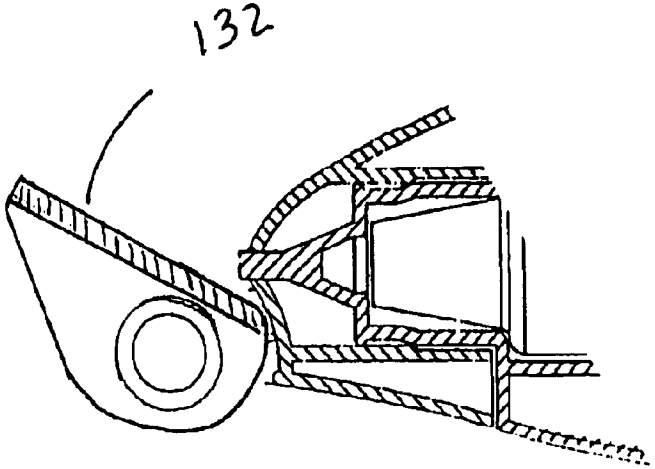
FIGS. 15A and 15B are views of brushes (130) and pads (132) that may be associated applicator embodiments of this invention.
Figure 15A:
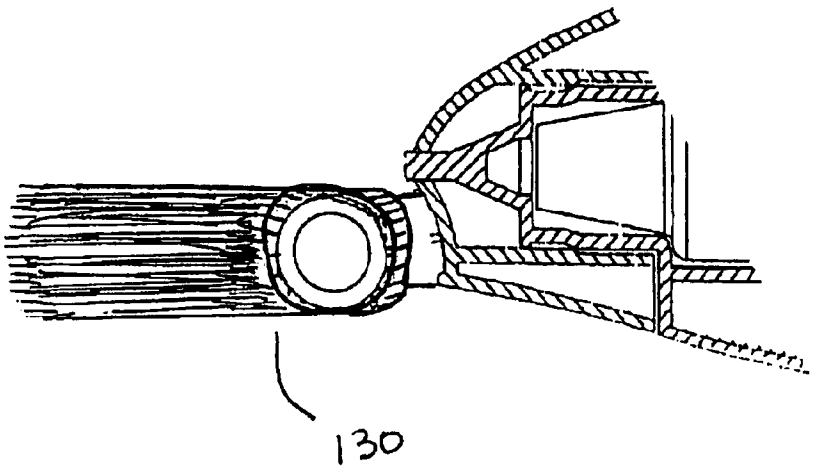

FIG. 13 is a roller sleeve 100 that complementary to roller holder 116 shown in FIG. 14. The combination of roller sleeve 100 and roller holder 116 form a two piece roller core similar to one piece roller core 80 shown in FIGS. 6A and 6B. Roller sleeve 100 includes a male portion 118 that is complementary to and engages female opening 120 in roller sleeve 100. Roller sleeve 100 further includes a plurality of annular ribs 122. Annular ribs 122 act as a bearing surface to allow applicator 78 to rotate smoothly when applying a liquid to a surface. Roller sleeve also includes a two piece pin 84 and many other features of roller core 80 shown in FIGS. 6A and 6B.

Figure 7:
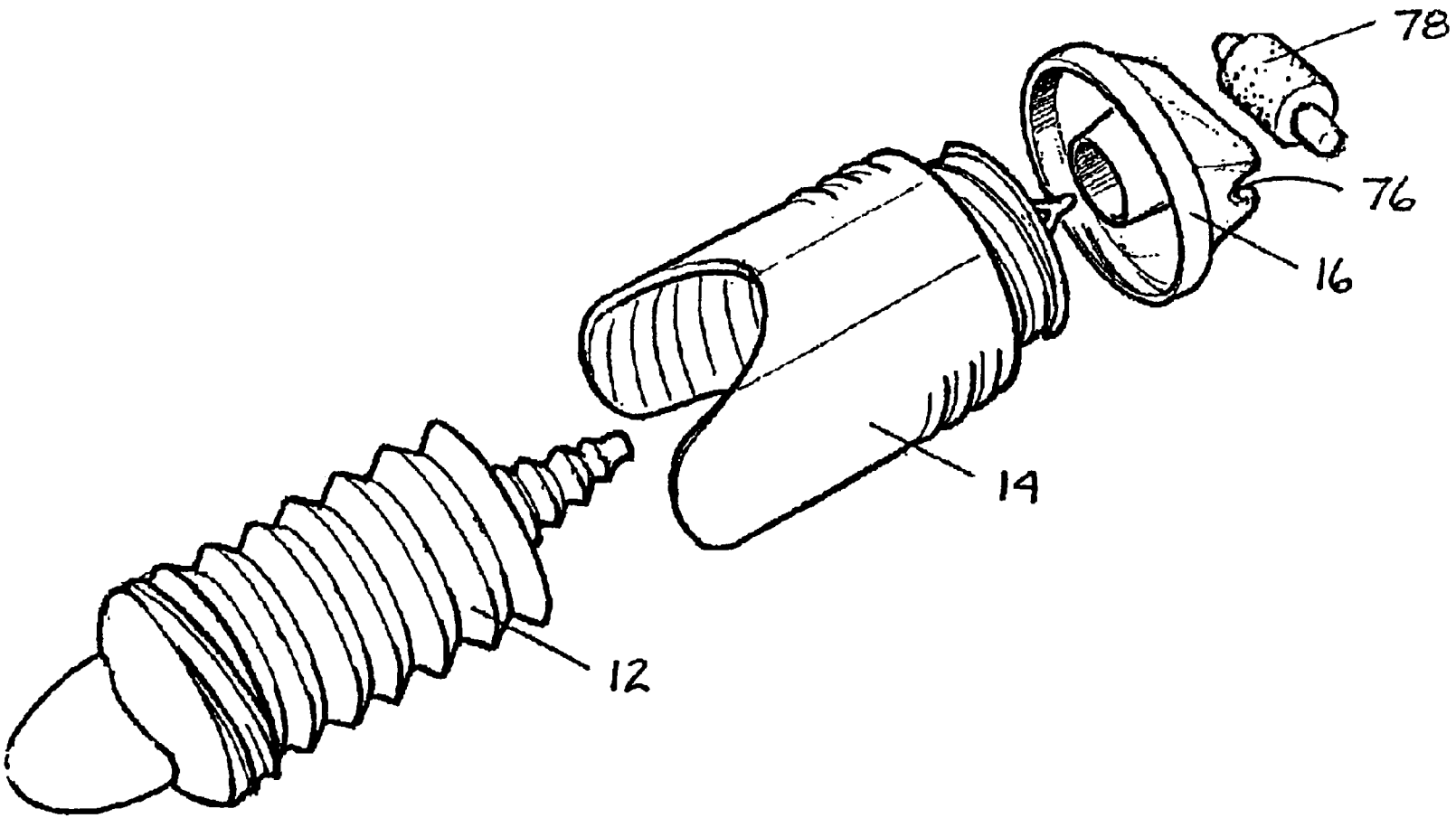
FIG. 7 is an exploded view of an alternative embodiment of a liquid applicator of this invention.

The foregoing detailed description has been given for clearness of understanding only, and unnecessary limitations are not to be construed therefrom. For example, FIG. 7 shows an alternative embodiment of the liquid applicator of this invention. The alternative embodiment includes a bellowed resilient bottle 12, a pin 14, a cap 16, applicator holder 76 and an applicator 78. The invention is not to be limited to the exact details shown and described since obvious modifications such as those shown in FIG. 7 will occur to those skilled in the art, and departure from the description herein conforms to the present invention is intended to be included within the scope of the claims.

We claim:

1. A liquid applicator comprising;

a resilient bottle adapted to hold a liquid and having an opening wherein the resilient bottled returns to its original form after being squeezed the resilient bottle further including a neck having a threaded outer surface and a hollow body wherein the neck is located between the bottle opening and the hollow body;

a pin including a body forming a first opening and a second opening wherein the pin body at least partially surrounds the resilient bottle and wherein the resilient bottle opening is concentric to the pin second opening the pin further including a threaded inner surface;

a cap including a first open end and second open end wherein the cap first open end is united with pin first opening and wherein the cap second open end is concentric to the pin second opening; and an applicator holder wherein the outer surface threads of the resilient bottle neck are complementary to the pin inner surface threads.

2. The liquid applicator of claim 1 including an applicator that is attached to the applicator holder such that the applicator is positioned adjacent to the cap first open end.

3. The liquid applicator of claim 2 wherein the applicator is selected from the group consisting of a brush, a pad, and a roller.

4. The liquid applicator of claim 1 wherein the pin is manufactured from a rigid plastic material.

5. A liquid applicator comprising a resilient bottle adapted to hold a liquid and having an opening wherein the resilient bottle returns to its original form after being squeezed;

a pin including a body forming a first opening and a second opening wherein the pin body at least partially surrounds the resilient bottle and wherein the resilient bottle opening is concentric to the pin second opening wherein the pin includes an annular wall dividing the pin first opening from the pin second opening wherein the annular wall has a first end that is united with a pin shoulder and wherein the pin second opening is concentric to the pin first opening and wherein the annular wall includes a threaded inner surface wherein the threaded inner surface is complementary to threads on the resilient bottle neck outer surface;

a cap including a first open end and second open end wherein the cap first open end is united with pin first opening and wherein the cap second open end is concentric to the pin second opening; and an applicator bolder.

6. The liquid applicator of claim 1 wherein a plug is associated with the pin second opening.

7. The liquid applicator of claim 6 wherein the pin plug has an outer diameter that is smaller than the diameter of the cap second open end.

8. A liquid applicator comprising:

a resilient bottle adapted to hold a liquid and having an opening wherein the resilient bottle returns to its original form after being squeezed;

a pin including a body forming a first opening and a second opening wherein the pin body at least partially surrounds the resilient bottle and wherein the resilient bottle opening is concentric to the pin second opening a cap including a first open end and second open end wherein the cap first open end is united with pin first opening and wherein the cap second open end is concentric to the pin second opening wherein the cap second open end is an annular wall having an inner surface and an outer surface wherein the cap annular wall inner surface includes threads; and an applicator holder.

9. The liquid applicator of claim 8 wherein the pin includes a shoulder and a neck located between the shoulder and the first opening wherein the neck includes an outer surface that is threaded wherein the a threads on the neck outer surface are complementary to the threads on cap annular wall inner surface.

10. A liquid applicator comprising;

a resilient bottle adapted to bold a liquid having a hollow body, an opening and a neck located between the hollow body and the opening wherein the neck has a threaded outer surface wherein the resilient bottle is capable of returning to its original form after being squeezed;

a pin including a body forming a first opening and a second opening, wherein the pin body at least partially surrounds the resilient bottle and wherein the resilient bottle opening is concentric to the pin second opening, the pin further including an annular wall having a first end associated with a shoulder dividing pin first opening from the pin second opening and a threaded inner surface wherein the threaded inner surface is complementary to the threads on bottle neck outer surface, a neck located between the shoulder and the second opening wherein the neck includes a threaded outer surface, and a plug associated with pin second opening;

a cap including a first open end and a second open end, wherein the pin first opening is united with the cap first open end, the pin second opening is concentric to the cap second open end and wherein the cap first open end is an annular wall having an inner surface and an outer surface wherein the annular wall inner surface includes threads that are complementary to threads on the pin neck outer surface;

an applicator holder united with the cap; and an applicator associated with the applicator holder such that the applicator is positioned adjacent to the cap first open end.

11.The liquid applicator of claim 10 wherein the applicator is selected from the group consisting of a roller, a brush, and a pad.

12. The liquid applicator of claim 11 wherein the applicator is a roller.

13. The liquid applicator of claim 10 wherein the resilient bottle opening has a diameter that is large enough to allow the resilient bottle to be quickly filled.

14. The liquid applicator of claim 13 wherein the resilient bottle opening has a diameter of from about 0.25 inches to about 0.40 inches.

* * * * *

UNITED STATES PATENT AND TRADEMARK OFFICE

CERTIFICATE OF CORRECTION

PATENT NO. : 6,905,274 B2
DATED : June 14, 2005
INVENTOR(S) : Zwaert et al.

It is certified that error appears in the above-identified patent and that said Letters Patent is hereby corrected as shown below:

Column 8,
Line 47, delete “bottled” and replace with -- bottle --.

Signed and Sealed this

Twenty-ninth Day of November, 2005

JON W. DUDAS
*Director of the United States Patent and Trademark Office*